US010309428B2

(12) United States Patent
Sakai

(10) Patent No.: US 10,309,428 B2
(45) Date of Patent: Jun. 4, 2019

(54) METHOD FOR CONTROLLING GAS-PRESSURE-DRIVEN APPARATUS AND GAS-PRESSURE-DRIVEN APPARATUS

(71) Applicant: CKD Corporation, Komaki-shi, Aichi (JP)

(72) Inventor: Atsuyuki Sakai, Komaki (JP)

(73) Assignee: CKD Corporation, Komaki-shi (JP)

( * ) Notice: Subject to any disclaimer, the term of this patent is extended or adjusted under 35 U.S.C. 154(b) by 293 days.

(21) Appl. No.: 15/353,064

(22) Filed: Nov. 16, 2016

(65) Prior Publication Data

US 2017/0152869 A1 Jun. 1, 2017

(30) Foreign Application Priority Data

Nov. 27, 2015 (JP) ..... 2015-231395

(51) Int. Cl.

| | |
|---|---|
| ***F15B 11/06*** | (2006.01) |
| ***F04B 43/073*** | (2006.01) |
| ***F15B 11/10*** | (2006.01) |
| ***F04B 43/00*** | (2006.01) |
| ***F04B 49/06*** | (2006.01) |

(52) U.S. Cl.

CPC ..... *F15B 11/06* (2013.01); *F04B 43/0081* (2013.01); *F04B 43/073* (2013.01); *F04B 49/065* (2013.01); *F15B 11/10* (2013.01); *F15B 2211/6313* (2013.01); *F15B 2211/6326* (2013.01); *F15B 2211/765* (2013.01); *F15B 2211/8855* (2013.01)

(58) Field of Classification Search

CPC ..... F15B 11/06; F15B 11/10

USPC ..... 91/361

See application file for complete search history.

(56) References Cited

U.S. PATENT DOCUMENTS 5,134,962 A * 8/1992 Amada ..... B05C 11/08 118/320

5,421,208 A * 6/1995 Packard ..... A61M 5/16886 417/384

(Continued)

FOREIGN PATENT DOCUMENTS

JP 5331986 B2 8/2013

JP 5779324 B2 7/2015

(Continued)

*Primary Examiner* — Thomas E Lazo

*Assistant Examiner* — Richard C Drake

(74) *Attorney, Agent, or Firm* — Beyer Law Group LLP

(57) ABSTRACT

A gas-pressure-driven apparatus includes a main body having a working chamber, a movable member moving relative to the main body with a pressure of the working chamber, a pressure sensor for detecting the pressure, a flow rate sensor for detecting the flow rate of the working gas. A method for controlling the apparatus includes calculating a pressure change amount from the detected pressure and an integrated flow rate from the detected flow rate when the pressure is changed in a state in which the volume of the working chamber cannot be changed, calculating an initial volume of the working chamber from the pressure change amount and the integrated flow rate, and calculating a post-change volume of the working chamber from the integrated flow rate and the initial volume after creation of a state in which the volume of the working chamber can be changed from the initial volume.

14 Claims, 9 Drawing Sheets

(56) References Cited

U.S. PATENT DOCUMENTS

| | | | | |
|---|---|---|---|---|
| 5,564,595 | A * | 10/1996 | Minissian | B67D 7/08 134/99.1 |
| 5,599,394 | A * | 2/1997 | Yabe | B05C 11/08 118/319 |
| 6,193,783 | B1 * | 2/2001 | Sakamoto | B01D 19/0063 95/247 |
| 8,636,477 | B2 * | 1/2014 | Nagasaki | F04B 43/073 417/21 |
| 9,316,218 | B2 * | 4/2016 | McCourt | F04B 43/0736 |
| 9,943,871 | B2 * | 4/2018 | Hashima | H01L 21/67051 |
| 2006/0029848 | A1 * | 2/2006 | Kaye | G01F 1/36 429/424 |
| 2007/0122291 | A1 * | 5/2007 | Okumura | F04B 49/08 417/46 |
| 2007/0177998 | A1 * | 8/2007 | Kato | F04B 7/02 417/395 |
| 2007/0267065 | A1 * | 11/2007 | Okumura | F04B 43/073 137/208 |
| 2012/0180724 | A1 * | 7/2012 | Kouketsu | B01B 1/005 118/712 |
| 2012/0181239 | A1 * | 7/2012 | Furusho | G03F 7/162 210/808 |
| 2013/0180451 | A1 * | 7/2013 | Horiuchi | H01L 21/67017 118/715 |
| 2015/0000517 | A1 * | 1/2015 | Yoshihara | B01D 19/0031 95/1 |
| 2016/0363118 | A1 * | 12/2016 | Sakai | F04B 43/06 |

FOREIGN PATENT DOCUMENTS

| | | | |
|---|---|---|---|
| JP | 5816726 | B2 | 10/2015 |
| JP | 5989881 | B2 | 8/2016 |

* cited by examiner

FIG. 4

(a) FORMULA FOR CALCULATING WORKING CHAMBER VOLUME $$V_{(n+1)} = V_{(n)} + Q_{V(n+1)} \cdot \Delta t$$

$$= V_{(0)} + \sum_{k=1}^{n+1} Q_{V(k)} \cdot \Delta t \quad \cdots F1$$

$V_{(0)}$: INITIAL VOLUME (b) UNIT-TIME VOLUME CHANGE (WORKING CHAMBER PRESSURE)

$$Q_{V(n+1)} = \frac{P0}{P_{(n+1)}} \cdot Q_{M(n+1)} \quad \cdots F2$$

P0 : REFERENCE PRESSURE
$P_{(n+1)}$: DETECTED PRESSURE (c) UNIT-TIME VOLUME CHANGE (REFERENCE PRESSURE)

$$Q_{M(n+1)} = Q_{A(n+1)} - Q_{P(n+1)} \quad \cdots F3$$

$Q_{A(n+1)}$: DETECTED FLOW RATE (d) PRESSURE CHANGE CORRESPONDING FLOW RATE $$Q_{P(n+1)} = V \cdot \frac{P_{(n+1)} - P_{(n)}}{P0} \cdot \frac{1}{\Delta t} \quad \cdots F4$$

V: OPERATION CHAMBER VOLUME (WORKING CHAMBER VOLUME + PIPE VOLUME)

(e) $$V = Q_{A(n+1)} \cdot \frac{P0}{\Delta P_{(n+1)}} \cdot \frac{\Delta t}{1} \quad \cdots F5$$

V: OPERATION CHAMBER VOLUME (WORKING CHAMBER VOLUME + PIPE VOLUME)
$Q_{A(n+1)}$: DETECTED FLOW RATE

METHOD FOR CONTROLLING GAS-PRESSURE-DRIVEN APPARATUS AND GAS-PRESSURE-DRIVEN APPARATUS

CROSS-REFERENCE TO RELATED APPLICATIONS

The present application claims priority based on Japanese Patent Application No. 2015-231395 filed on Nov. 27, 2015, and the entire contents of that application is incorporated by reference in this specification.

BACKGROUND OF THE INVENTION

1. Field of the Invention

The present invention relates to a gas-pressure-driven apparatus which moves a movable member in relation to a main body thereof in accordance with the pressure of a working chamber to which a working gas is supplied and from which the working gas is discharged.

2. Description of the Related Art

Conventionally, there has been known a method for calculating the moved position and movement amount of a piston (i.e., a movable member) in a hydraulic cylinder on the basis of the flow rate of pressurized fluid (see, e.g., Japanese Patent Gazette No. 5331986). Since the method disclosed in Japanese Patent Gazette No. 5331986 monitors the integrated flow rate of the pressurized fluid whose integration starts from a state in which the piston has stopped at its initial position, even when the piston stops at an intermediate position between the initial position and a displacement end position, the intermediate position to which the piston has moved can be detected.

However, the method disclosed in Japanese Patent Gazette No. 5331986 cannot determine the initial position of the piston in the case where the initial position of the piston is not one of the displacement end positions; i.e., opposite ends of the movement range of the piston. In such a case, the moved position of the piston (which correlates with the volume of the working chamber) cannot be calculated.

SUMMARY OF THE INVENTION

The present invention has been accomplished in view of the above-described problem, and its main object is to provide a method for controlling a gas-pressure-driven apparatus which can calculate the volume of a working chamber irrespective of the initial position of a movable member.

Aspects of the present invention for solving the above-described problem and their advantageous effects will now be described.

A first aspect of the present invention is a method for controlling a gas-pressure-driven apparatus comprising a main body having a working chamber to which a working gas is supplied and from which the working gas is discharged, a supply and discharge section for supplying the working gas to the working chamber and discharging the working gas from the working chamber, a movable member which moves relative to the main body in accordance with a pressure of the working chamber, a pressure sensor for detecting a pressure of a space including the working chamber, and a flow rate sensor for detecting a flow rate of the working gas flowing into and flowing out of the working chamber.

The present method comprises creating a state in which a volume of the working chamber cannot be changed and changing the pressure of the working chamber in this state by controlling the supply and discharge section; calculating a pressure change amount on the basis of the pressure detected by the pressure sensor and calculating an integrated flow rate on the basis of the flow rate detected by the flow rate sensor when the pressure of the working chamber is changed; calculating an initial volume of the working chamber on the basis of the pressure change amount and the integrated flow rate; and calculating a post-change volume of the working chamber after its volume has changed, on the basis of the initial volume and the integrated flow rate calculated from the flow rate detected by the flow rate sensor after creation of a state in which the volume of the working chamber can be changed from the initial volume.

In the above-described gas-pressure-driven apparatus, the working gas is supplied to and discharged from the working chamber by the supply and discharge section. The movable member is moved relative to the main body in accordance with the pressure of the working chamber. The pressure of the space including the working chamber is detected by the pressure sensor. The flow rate of the working gas flowing into and flowing out of the working chamber is detected by the flow rate sensor.

According the above-described method, a state in which the volume of the working chamber cannot be changed is created, and the pressure of the working chamber is changed by controlling the supply and discharge section. As a result, the working gas flows into the working chamber or flows out of the working chamber. At that time, the working gas flowing into the working chamber or flowing out of the working chamber contributes to change in the pressure of the working chamber in the state in which the volume of the working chamber cannot be changed. The amount of the change in the pressure of the working chamber caused by the working gas flowing into the working chamber or flowing out of the working chamber changes in accordance with the volume of the working chamber at the time when the volume of the working chamber is made unchangeable (i.e., the initial volume of the working chamber). Therefore, the relation between the pressure change amount of the working chamber and the integrated flow rate of the working gas (i.e., the amount of the working gas flowing into or flowing out of the working chamber) reflects the initial volume of the working chamber. Accordingly, the initial volume of the working chamber can be calculated from the pressure change amount of the working chamber and the integrated flow rate of the working gas flowing into the working chamber.

Further, after a state in which the volume of the working chamber can be changed from the initial volume has been created, the integrated flow rate is calculated from the flow rate of the working gas detected by the flow rate sensor. The integrated flow rate in the state in which the volume of the working chamber can be changed correlates with the volume change amount of the working chamber. Therefore, the post-change volume of the working chamber after its volume has changed can be calculated from the integrated flow rate and the initial volume. In addition, irrespective of the initial position of the movable member, the initial volume of the working chamber can be calculated, whereby the post-change volume of the working chamber can be calculated.

A second aspect of the present invention is a gas-pressure-driven apparatus. The gas-pressure-driven apparatus comprises a main body having a working chamber to which a working gas is supplied and from which the working gas is discharged; a supply and discharge section for supplying the working gas to the working chamber and discharging the working gas from the working chamber; a movable member which moves relative to the main body in accordance with a pressure of the working chamber; a pressure sensor for detecting a pressure of a space including the working chamber; a flow rate sensor for detecting a flow rate of the working gas flowing into and flowing out of the working chamber; and a control section. The control section creates a state in which a volume of the working chamber cannot be changed, changes the pressure of the working chamber in this state by controlling the supply and discharge section, and calculates a pressure change amount on the basis of the pressure detected by the pressure sensor and calculates an integrated flow rate on the basis of the flow rate detected by the flow rate sensor when the pressure of the working chamber is changed. The control section calculates an initial volume of the working chamber on the basis of the pressure change amount and the integrated flow rate, and calculates a post-change volume of the working chamber after its volume has changed, on the basis of the initial volume and the integrated flow rate calculated from the flow rate detected by the flow rate sensor after creation of a state in which the volume of the working chamber can be changed from the initial volume.

According to the above-described configuration, the working gas is supplied to and discharged from the working chamber by the supply and discharge section. The movable member is moved relative to the main body in accordance with the pressure of the working chamber. The pressure of the space including the working chamber is detected by the pressure sensor. The flow rate of the working gas flowing into and flowing out of the working chamber is detected by the flow rate sensor.

By the control section, a state in which the volume of the working chamber cannot be changed is created, and the pressure of the working chamber is changed by controlling the supply and discharge section. As a result, the working gas flows into the working chamber or flows out of the working chamber. At that time, the working gas flowing into the working chamber or flowing out of the working chamber contributes to change in the pressure of the working chamber in the state in which the volume of the working chamber cannot be changed. The amount of the change in the pressure of the working chamber caused by the working gas flowing into the working chamber or flowing out of the working chamber changes in accordance with the volume of the working chamber at the time when the volume of the working chamber is made unchangeable (i.e., the initial volume of the working chamber). Therefore, the relation between the pressure change amount of the working chamber and the integrated flow rate of the working gas (i.e., the amount of the working gas flowing into or flowing out of the working chamber) reflects the initial volume of the working chamber. Accordingly, the initial volume of the working chamber can be calculated from the pressure change amount of the working chamber and the integrated flow rate of the working gas flowing into the working chamber.

Further, after a state in which the volume of the working chamber can be changed from the initial volume has been created, the integrated flow rate is calculated from the flow rate of the working gas detected by the flow rate sensor. The integrated flow rate in the state in which the volume of the working chamber can be changed correlates with the volume change amount of the working chamber. Therefore, the post-change volume of the working chamber after its volume has changed can be calculated from the integrated flow rate and the initial volume. In addition, irrespective of the initial position of the movable member, the initial volume of the working chamber can be calculated, whereby the post-change volume of the working chamber can be calculated.

The above and other objects, features, and advantages of the present invention will be apparent from the following description when taken in conjunction with the accompanying drawings which illustrate preferred embodiments of the present invention by way of example.

BRIEF DESCRIPTION OF THE DRAWINGS

FIG. 4 is a set of formulas for calculating the working chamber volume of a pump from the pressure and flow rate of operation air;

DESCRIPTION OF THE PREFERRED EMBODIMENTS

First Embodiment

A first embodiment of the present invention which is embodied as a chemical supply system used in a semiconductor production line or the like will now be described with reference to the drawings.

Figure 1:
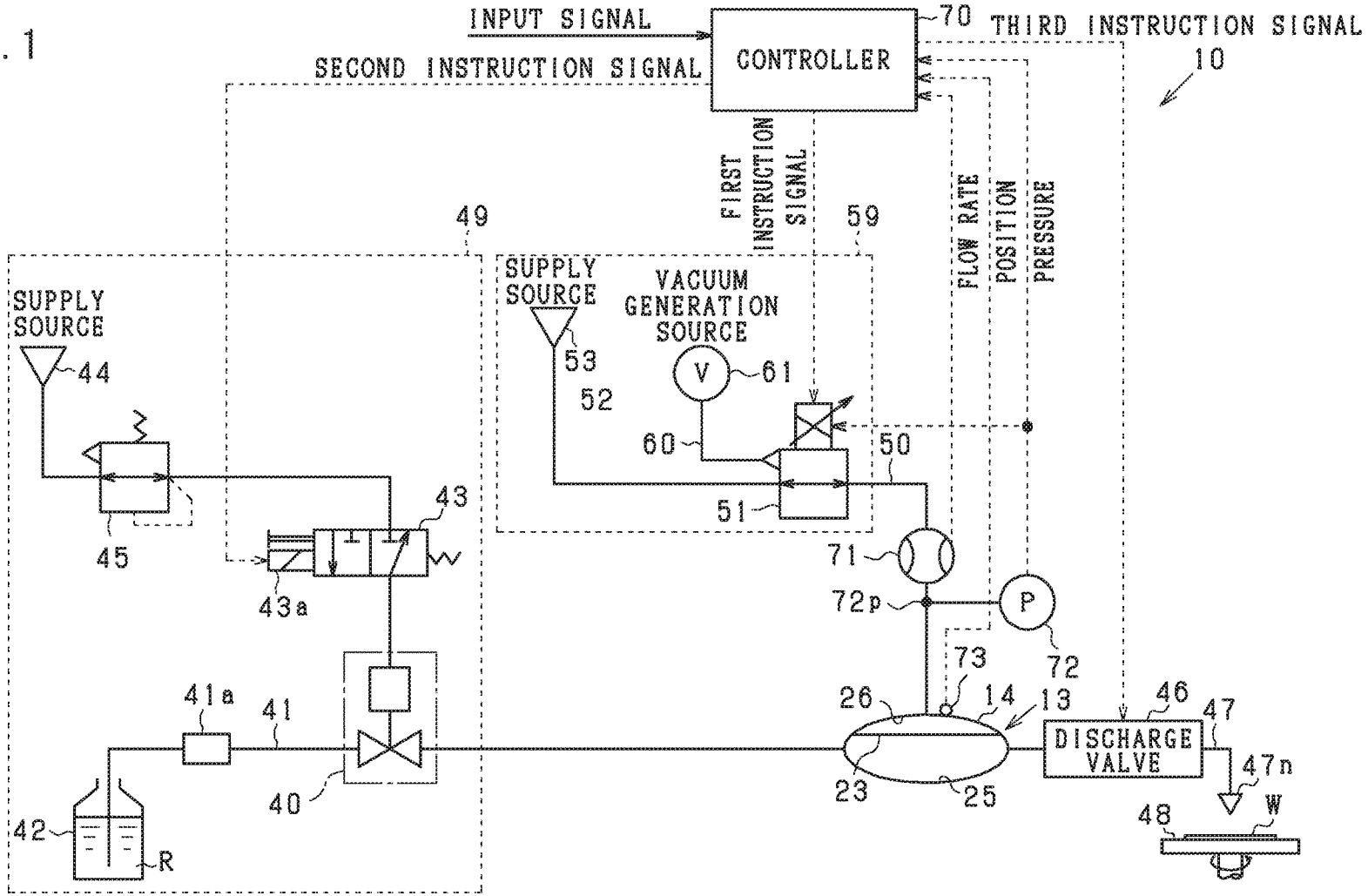
FIG. 1 is a circuit diagram illustrating a chemical supply system.

FIG. 1 is a circuit diagram showing a chemical supply system 10 (i.e., a gas-pressure-driven apparatus). As shown in FIG. 1, the chemical supply system 10 supplies resist solution R, which is a chemical solution (liquid), from an end nozzle 47*n* to an area near the center of a semiconductor wafer W disposed on a rotating plate 48. The resist solution R is spread from the area near the center of the semiconductor wafer W to the peripheral edge of the semiconductor wafer W by centrifugal force.

The chemical supply system 10 includes a diaphragm pump 13, a pump drive section 59, a chemical supply section 49, a suction pipe 41, a discharge pipe 47, a discharge valve 46, a flow rate sensor 71, a pressure sensor 72, a position sensor 73, a controller 70, etc.

The pump 13 includes a main body 14 having a pump chamber 25 and a working chamber 26 to which a pressurized operation air (i.e., a working gas) is supplied and from which the pressurized operation air is discharged; and a diaphragm 23 which separates the pump chamber 25 and the working chamber 26 from each other. The diaphragm 23 (i.e., a movable member) is displaced (i.e., moves) in relation to the main body 14 in accordance with the pressure of the working chamber 26. The resist solution R is sucked into the pump chamber 25 through the suction pipe 41, and then discharged from the pump chamber 25 to the discharge pipe 47.

The pump drive section 59 (i.e., a supply and discharge section) includes a supply source 53 which supplies pressurized operation air (i.e., a working gas), a vacuum generation source 61 which generates a negative pressure, an electro-pneumatic regulator 51, etc.

The operation air is supplied from the supply source 53 to the electro-pneumatic regulator 51 through a supply pipe 52. The operation air is discharged from the electro-pneumatic regulator 51 through a discharge pipe 60 to the vacuum generation source 61. The electro-pneumatic regulator 51 has a solenoid valve, etc. and switches a to-be-used source between the supply source 53 and the vacuum generation source 61. The operation air is supplied to the working chamber 26 of the pump 13 from the electro-pneumatic regulator 51 through an air pipe 50 (i.e., a working gas passage). The operation air is discharged from the working chamber 26 of the pump 13 to the electro-pneumatic regulator 51 through the air pipe 50. In response to a first instruction signal (for example, a target pressure) from the controller 70, the electro-pneumatic regulator 51 controls the pressure of the operation air to a set pressure, which is the target pressure. The pump drive section 59 is not limited to that including the electro-pneumatic regulator 51, and may be a circuit of any other type for controlling the pressure of the operation air.

The chemical supply section 49 includes a resist bottle 42 which stores the resist solution R, a suction valve 40, a supply source 44 which supplies the pressurized operation air, a pressure-adjusting valve 45, a switching valve 43, etc.

The resist bottle 42 (i.e., a liquid container) is connected by the suction pipe 41 (i.e., an inflow passage) to the suction valve 40 with a filter 41*a* disposed in the suction pipe 41. The resist bottle 42 may be located at a position higher or lower than the pump chamber 25. The filter 41*a* removes impurities such as minute particles contained in the resist solution R. The suction valve 40 opens and closes the suction pipe 41. The operation air is supplied from the supply source 44 to the suction valve 40 through the pressure-adjusting valve 45 and the switching valve 43. The pressure-adjusting valve 45 adjusts the pressure of the operation air supplied from the supply source 44 to a pressure for operating the suction valve 40. The switching valve 43 is a solenoid valve for switching the connection state of the flow passage by an electromagnetic switching section 43*a* having an electromagnetic solenoid. In response to a second instruction signal (for example, ON instruction or OFF instruction) from the controller 70, the switching valve 43 switches the connection state of the flow passage alternatingly between a state in which the operation air is supplied to the suction valve 40 and a state in which the suction valve 40 communicates with the atmosphere. The resist solution R flows into the pump chamber 25 of the pump 13 through the suction pipe 41 when the suction valve 40 is opened.

The pump chamber 25 of the pump 13 is connected by the discharge pipe 47 (i.e., an outflow passage) to the end nozzle 47*n* through the discharge valve 46. The discharge valve 46 has the same structure as the suction valve 40 described above. In response to a third instruction signal (for example, ON instruction or OFF instruction) from the controller 70, the discharge valve 46 is switched alternatingly between an open state and a closed state. The resist solution R flows out of the pump chamber 25 of the pump 13 through the discharge pipe 47 when the discharge valve 46 is opened. Thus, the resist solution R is supplied to the end nozzle 47*n* through the discharge pipe 47.

The flow rate sensor 71 detects the flow rate of the operation air which flows through the air pipe 50; namely, the flow rate of the operation air which flows into or flows out of the working chamber 26 of the pump 13.

The pressure sensor 72 detects the pressure of the operation air inside the air pipe 50; namely, the pressure of the space including the working chamber 26 and the air pipe 50. Specifically, the pressure sensor 72 detects the pressure at a pressure detection point 72*p* provided in the air pipe 50 between the pump 13 and the flow rate sensor 71.

The position sensor 73 detects the position of the diaphragm 23. Specifically, the position sensor 73 enters an off state when the diaphragm 23 is located on the pump chamber 25 side (i.e., on the discharge side) with respect to the neutral position. The position sensor 73 enters an on state when the diaphragm 23 is located at the neutral position or on the working chamber 26 side (i.e., on the suction side) with respect to the neutral position. The neutral position is a position where the tension generated in the diaphragm 23 due to movement of the diaphragm 23 becomes smaller than a predetermined value (for example, the tension becomes zero); namely, a position where the tension generated in the diaphragm can be ignored.

The controller 70 (i.e., a control section) is an electronic control apparatus mainly composed of a microcomputer which includes a CPU, and various kinds of memories, etc. The controller 70 controls the states of supply and discharge of the resist solution R by the pump 13. The controller 70 receives an input signal (for example, a suction instruction signal or a discharge instruction signal) from an unillustrated administration computer which administers the entirety of the present system. The controller 70 receives a flow rate detection signal from the flow rate sensor 71, a pressure detection signal from the pressure sensor 72, and a position detection signal from the position sensor 73. On the basis of these input signals, the controller 70 controls the open/closed states of the suction valve 40 and the discharge valve 46 and the state of the electro-pneumatic regulator 51 (i.e., the pump drive section 59). In the present embodiment, the controller 70 estimates the volume of the working chamber 26 and the suction-side hydraulic head pressure (i.e., fluid pressure) of the resist solution R. At that time, in the chemical supply system 10, the temperatures of the operation air and the resist solution R are constant or can be considered to be constant.

Figure 2:
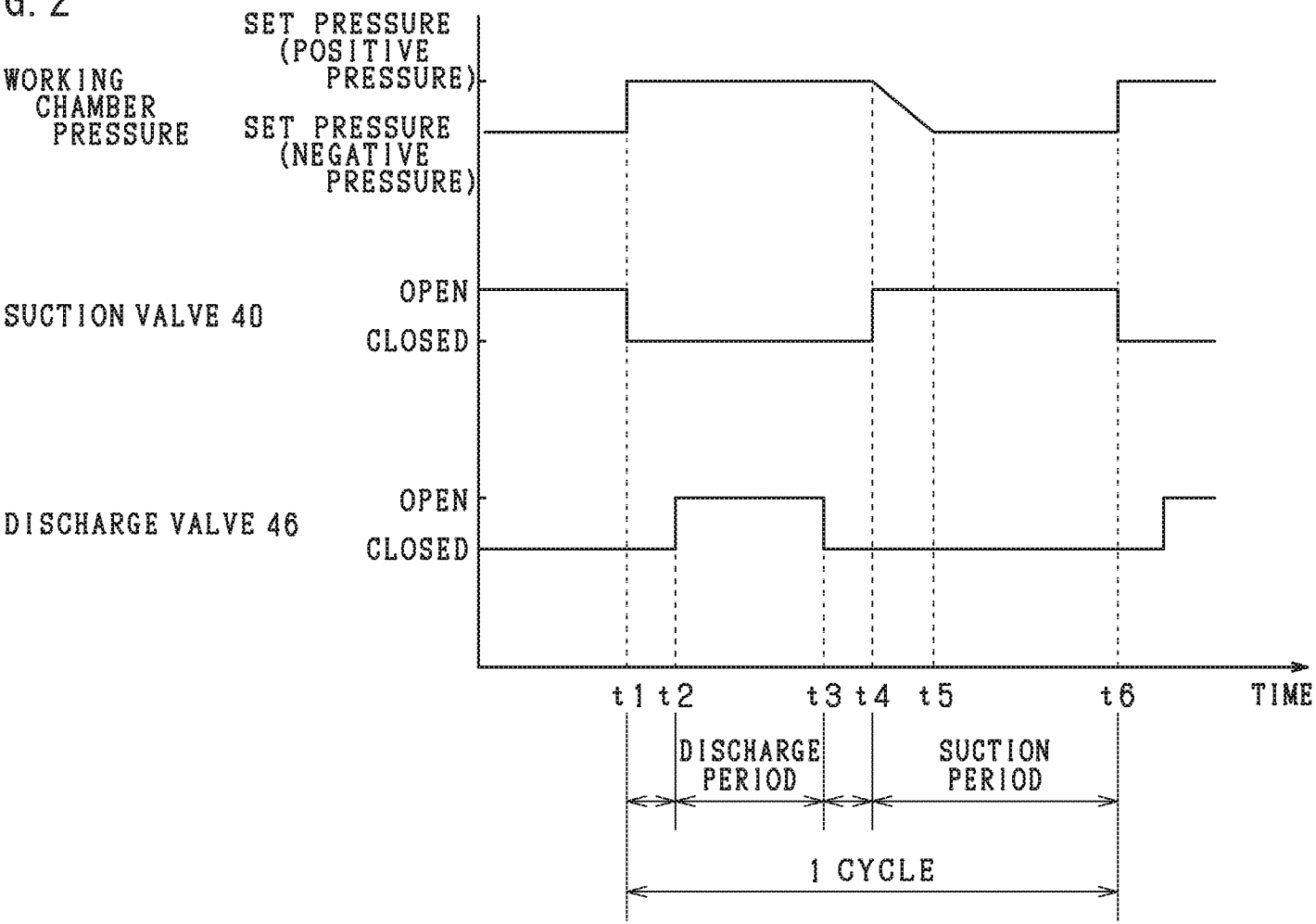
FIG. 2 is a time chart showing the basic operation of the chemical supply system.

FIG. 2 is a time chart showing the basic operation of the chemical supply system 10. The chemical supply system 10 operates by repeating a cycle including discharge of the resist solution R from the pump 13 and suction of the resist solution R into the pump 13. The operation of the chemical supply system 10 is controlled by the controller 70 described above.

As shown in FIG. 2, the suction valve 40 is opened and the discharge valve 46 is closed before time t1. The pressure of the working chamber 26 is a negative pressure which is the set pressure. In this state, the pump chamber 25 has expanded to have the maximum volume, and the working chamber 26 has contracted to have the minimum volume.

At time t1, while the discharge valve 46 remains in the closed state, the suction valve 40 is closed. After the suction valve 40 is closed, the set pressure of the electro-pneumatic regulator 51 is changed to a positive pressure. Consequently, the pressure of the working chamber 26 is quickly controlled to the set positive pressure by the electro-pneumatic regulator 51. In this state, since both the suction valve 40 and the discharge valve 46 are in the closed state, the pump chamber 25 is in a state (specifically, a standstill state) in which a positive pressure (set pressure) is applied from the working chamber 26 side to the pump chamber 25 via the diaphragm 23.

The pressure at the pressure detection point 72*p* (i.e., the pressure of the working chamber 26) is detected by the pressure sensor 72 in real time. The flow rate of the operation air that flows into or out of the working chamber 26 is detected by the flow rate sensor 71 in real time. The above-described state is maintained until time t2 at which the flow rate detected by the flow rate sensor 71 becomes smaller than a predetermined value (for example, the flow rate becomes zero). Time t2 may be the time at which fluctuation of the pressure detected by the pressure sensor 72 becomes smaller than a predetermined value (for example, the fluctuation of the pressure becomes zero).

At time t2, the discharge valve 46 is opened. This allows discharge of the resist solution R from the pump chamber 25 through the discharge valve 46. Therefore, as a result of pressing of the diaphragm 23 by the operation air in the direction from the working chamber 26 to the pump chamber 25, the discharge of the resist solution R from the pump chamber 25 is started. This state is maintained during a period during which the working chamber 26 can be expanded to the maximum volume and the pump chamber 25 can be contracted to the minimum volume; namely, a period from time t2 to time t3. Thus, the discharge of the resist solution R from the pump 13 ends.

At time t3, the discharge valve 46 is closed. At time t4 after elapse of a predefined time after t3, the suction valve 40 is opened.

From time t4 to t5, the set pressure of the operation air is not changed rapidly. Rather, it is gradually changed from a positive pressure to a negative pressure at a predetermined rate. This restrains occurrence of a bubble generation phenomenon which occurs when the pressure of the pump chamber 25 decreases rapidly. As the set pressure of the operation air decreases (for example, to a negative pressure), the diaphragm 23 is sucked from the pump chamber 25 side toward the working chamber 26 side. This state is maintained during a period during which the pump chamber 25 can be expanded to the maximum volume and the working chamber 26 can be contracted to the minimum volume; namely, a period from time t5 to time t6. Thus, the suction of the resist solution R into the pump 13 ends. Then, at time t6, the control same as that at time t1 is executed.

Figure 3:
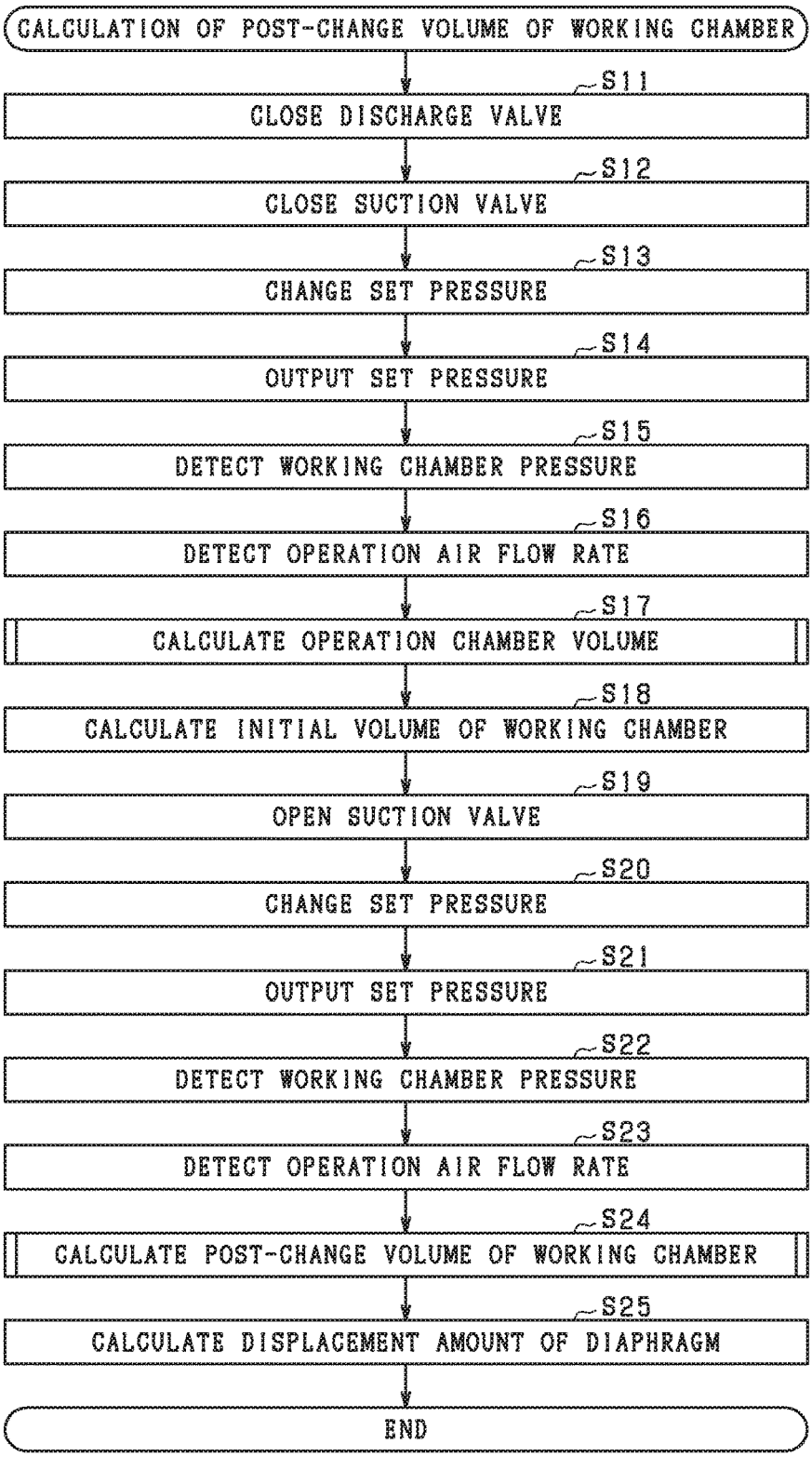
FIG. 3 is a flowchart showing a series of processes for calculating the post-change volume of a working chamber.

Calculation of Post-Change Volume:

FIG. 3 is a flowchart showing a series of processes for calculating the post-change volume of the working chamber 26. This series of processes is executed by the controller 70.

First, the controller 70 closes the discharge valve 46 and the suction valve 40 (S11, S12). Namely, the controller 70 temporarily closes the two valves 46 and 40 to thereby create a state in which the volume of the working chamber 26 cannot be changed.

Subsequently, the controller 70 changes the set pressure of the working chamber 26 (S13). Specifically, the the controller 70 changes the set pressure to a pressure at which a change in the flow rate of the operation air with a change in the pressure of the working chamber 26 can be detected accurately in a state in which the discharge valve 46 and the suction valve 40 are closed; i.e., in a state in which the diaphragm 23 does not move. For example, the controller 70 raises the set pressure from the atmospheric pressure to a predetermined pressure.

Subsequently, the controller 70 outputs the set pressure changed in S13 to the electro-pneumatic regulator 51 (S14). As a result, the electro-pneumatic regulator 51 starts an operation of controlling the pressure of the working chamber 26 to the set pressure.

Subsequently, the controller 70 reads the pressure of the working chamber 26 detected by the pressure sensor 72 (S15) and reads the flow rate of the operation air flowing into and out of the working chamber 26 detected by the flow rate sensor 71 (S16).

Subsequently, the controller 70 calculates the volume of the operation chamber (S17). Specifically, the controller 70 calculates an operation chamber volume V which is the total of the volume V(n) of the working chamber 26 at that time and the volume of the air pipe 50 by using Formula F5 of FIG. 4. Since the diaphragm 23 does not move, detected flow rate QA(n+1) which is the flow rate of the operation air detected by the flow rate sensor 71 at that time can be considered to be equal to pressure change corresponding flow rate QP(n+1). The pressure change corresponding flow rate QP(n+1) is a flow rate which contributes to change in the pressure of the working chamber 26 but does not contribute to change in the volume thereof. QA(n+1) represents the flow rate detected this time; P0 represents a reference pressure; ΔP(n+1) represents a pressure change (the pressure P(n+1) detected this time—the pressure P(n) detected last time); and Δt represent a predetermined sampling interval. Notably, the product of the detected flow rate QA(n+1) and the time Δt corresponds to the integrated flow rate.

Subsequently, the controller 70 calculates an initial volume V(0) of the working chamber 26 by subtracting the volume of the air pipe 50 from the operation chamber volume V (S18). Notably, the volume of the air pipe 50 is known.

Subsequently, the controller 70 opens the suction valve 40 (S19). Namely, the controller 70 creates a state in which the volume of the working chamber 26 can be changed from the initial volume V(0).

Subsequently, the controller 70 changes the set pressure of the working chamber 26 (S20), outputs the set pressure changed in S20 to the electro-pneumatic regulator 51 (S21), reads the pressure of the working chamber 26 detected by the pressure sensor 72 (S22), and reads the flow rate of the operation air flowing into and out of the working chamber 26 detected by the flow rate sensor 71 (S23). The processes of the S20 to S23 are the same as those of S13 to S16. However, in S20, the controller 70 changes the set pressure in accordance with the driven state of the pump 13; specifically, the state in which the pump 13 is driven for suction. Notably, S19 may be replaced with a step of opening the discharge valve 46, and S20 may be replaced with a step of changing the set pressure in accordance with the driven state of the pump 13; specifically, the state in which the pump 13 is driven for discharge.

Subsequently, the controller 70 calculates the post-change volume V(n+1) of the working chamber 26 (S24). This calculation will be described in detail with reference to FIG. 4.

Subsequently, the controller 70 calculates a displacement amount of the diaphragm 23 on the basis of the volume change amount ΔV(n+1) of the working chamber 26 (S25). Specifically, the controller 70 calculates a displacement amount of the diaphragm 23 on the basis of a preset relation between the volume change amount ΔV(n+1) of the working chamber 26 and the displacement amount of the diaphragm 23 and the volume change amount ΔV(n+1) from the initial volume V(0) of the working chamber 26 to the post-change volume V(n+1). The relation between the volume change amount ΔV(n+1) of the working chamber 26 and the displacement amount of the diaphragm 23 is previously determined. Therefore, the relation between the volume change amount ΔV(n+1) of the working chamber 26 and the displacement amount of the diaphragm 23 is set in advance on the basis of the results of an experiment or design values.

After that, the controller 70 ends of this series of processes (END). Notably, this series of processes corresponds to the method for controlling a gas-pressure-driven apparatus.

Calculation of Post-Change Volume of Working Chamber:

FIG. 4 is a set of formulas for calculating the post-change volume of the working chamber 26 of the pump 13 on the basis of the pressure and flow rate of the operation air. Formulas F1 to F4 in FIG. 4 are calculation formulas for calculating the post-change volume of the working chamber 26 from the pressure and flow rate of the operation air supplied to the working chamber 26, in consideration of the compressibility of the operation air, in a state in which both the pressure and volume of the working chamber 26 change.

Formula F1 is used for calculating the post-change volume of the working chamber 26 at the present moment (n+1). Specifically, formula F1 is used for calculating the post-change volume V(n+1) of the working chamber 26 at the present moment (n+1) by adding, to the volume V(n) of the working chamber 26 at the previous moment (n), a change in the volume of the working chamber 26 during the predetermined sampling interval of Δt, which change is represented by Qv(n+1)·Δt. Namely, the post-change volume V(n+1) is calculated by adding, to the initial volume V(0) of the working chamber 26, a change in the volume of the working chamber 26 during each sampling interval of Δt, which change is represented by Qv(k)·Δt.

Formula F2 is used for calculating the unit-time volume change Qv(n+1) of the working chamber 26 at the present detected pressure P(n+1) (the pressure of the working chamber 26 detected at the present moment (n+1)) from the flow rate QM(n+1) at a reference pressure P0. The detected pressure P(n+1) is the pressure of the working chamber 26 detected by the pressure sensor 72. The unit-time volume change means the flow rate, and the integrated volume change means the integrated flow rate. Thus, the flow rate at the assumed reference pressure P0 can be converted to the flow rate at the pressure P(n+1) and used. The volume change Qv(n+1) calculated from Formula F2 is substituted in Formula F1.

Formula F3 is used for calculating the flow rate QM(n+1) at the reference pressure P0 through use of the detected flow rate QA(n+1). The detected flow rate QA(n+1) is the flow rate of the operation air detected by the flow rate sensor 71. The flow rate QM(n+1) at the reference pressure P0 is calculated by subtracting a pressure change corresponding flow rate QP(n+1) from the detected flow rate QA(n+1). The pressure change corresponding flow rate QP(n+1) is a flow rate which contributes to change in the pressure of the working chamber 26 and does not contribute to change in the volume of the working chamber 26. In other words, the flow rate QM(n+1) is a flow rate which contributes to change in the volume of the working chamber 26; i.e., a volume change corresponding flow rate. The flow rate QM(n+1) at the reference pressure P0 calculated by Formula F3 is substituted in Formula F2.

Formula F4 is used for calculating the pressure change corresponding flow rate QP(n+1). The pressure change corresponding flow rate QP(n+1) is a portion of the flow rate of the operation air which contributes only to change in the pressure of the working chamber 26. The pressure change corresponding flow rate QP(n+1) assumes a positive value when the pressure of the working chamber 26 is increasing and assumes a negative value when the pressure of the working chamber 26 is decreasing. The pressure change (P(n+1)−P(n)) is the change in the pressure detected by the pressure sensor 72 during the sampling interval Δt. The actually measured value of the pressure change (P(n+1)−P(n)) may be used as is. Alternatively, the average of the measured values of the pressure change (P(n+1)−P(n)) within a predetermined time period may be used. The calculated value of the pressure change corresponding flow rate QP(n+1) depends on the operation chamber volume V which is the sum of the volume V(n) of the working chamber 26 at that time and the volume of the air pipe 50. The pressure change corresponding flow rate QP(n+1) calculated by Formula F4 is substituted in Formula F3. As described above, the post-change volume of the working chamber 26 can be calculated through use of Formula F1.

Estimation of Suction-Side Hydraulic Head Pressure

Figure 5:
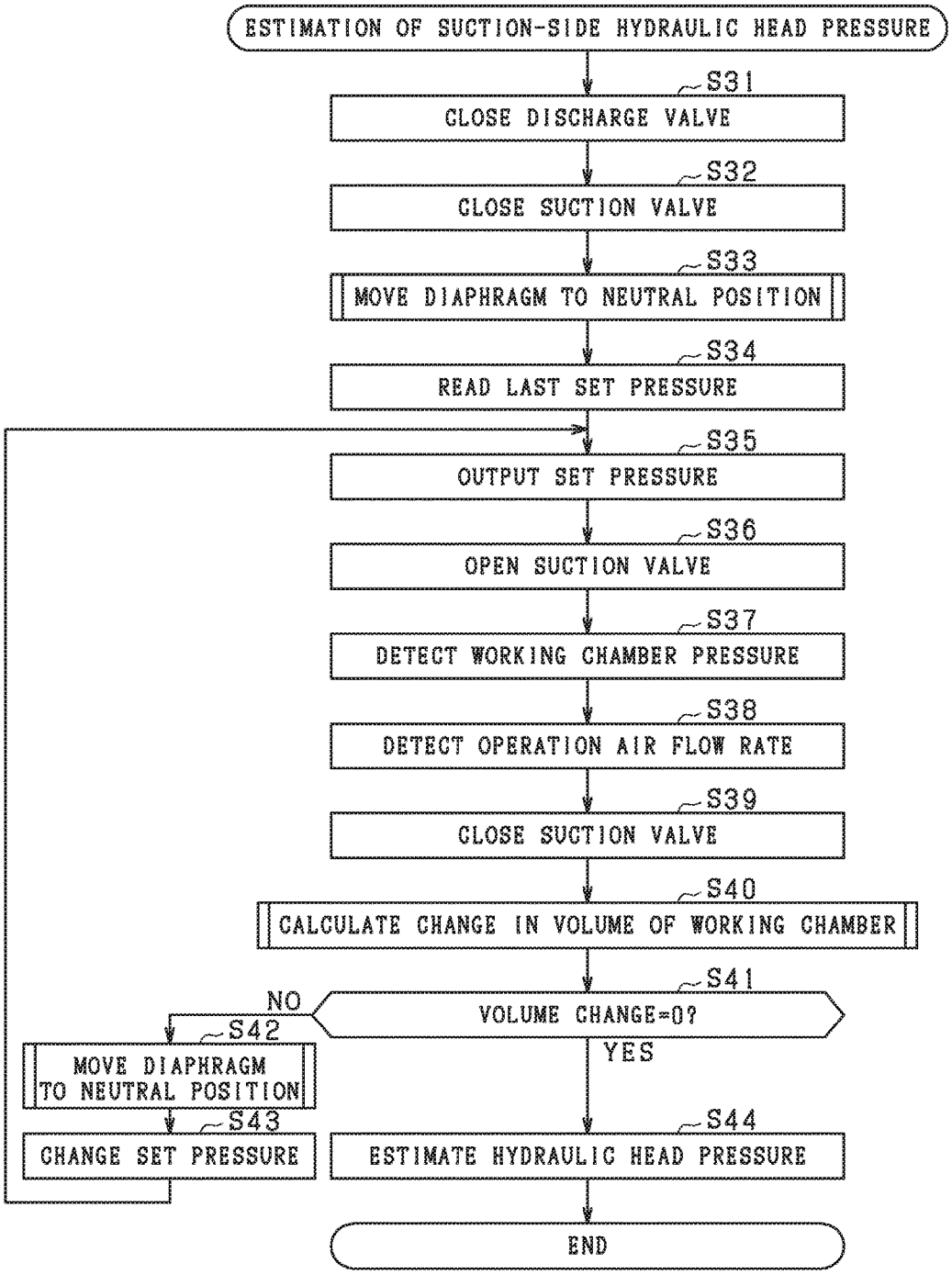
FIG. 5 is a flowchart showing a series of processes for estimating suction-side hydraulic head pressure.

FIG. 5 is a flowchart showing a series of processes for estimating the hydraulic head pressure on the suction-side. The series of processes is executed by the controller 70.

First, the controller 70 closes the discharge valve 46 and the suction valve 40 (S31 and S32). Namely, both the valves 46 and 40 are closed temporarily.

Subsequently, the controller 70 moves the diaphragm 23 to the neutral position described above (S33). The neutral position is a position where the tension generated in the diaphragm 23 due to movement of the diaphragm 23 becomes smaller than a predetermined value (for example, the tension becomes zero). The details of this process will be described later.

Subsequently, the controller 70 reads the set pressure which was used in the series of processes performed last time (S34). Specifically, the controller 70 reads the set pressure which was output to the electro-pneumatic regulator 51 when the series of processes for estimating the suction-side hydraulic head pressure was performed last time.

Subsequently, the controller 70 outputs the set pressure read in S34 to the electro-pneumatic regulator 51 (S35). As a result, the electro-pneumatic regulator 51 starts an operation of controlling the pressure of the working chamber 26 to the set pressure. The controller 70 then opens the suction valve 40 (S16). Namely, the controller 70 starts the process for estimating the hydraulic head pressure from the state in which the pressure of the working chamber 26 has been controlled to the set pressure in the series of processes performed last time. In the case where the controller 70 cannot acquire the set pressure which was used in the series of processes performed last time, the controller 70 starts the process for estimating the hydraulic head pressure while using a predetermined initial set pressure.

Subsequently, the controller 70 reads the pressure of the working chamber 26 detected by the pressure sensor 72 (S37), and reads the flow rate of the working air flowing into and out of the working chamber 26 detected by the flow rate sensor 71 (S38).

Subsequently, the controller 70 closes the suction valve 40 (S39). The controller 70 then calculates the change in the volume of the working chamber 26 on the basis of the detected pressure and flow rate (S40). The volume change ΔV of the working chamber 26 can be calculated on the basis of the formulas of FIG. 4 as in the case of the post-change volume V(n+1) of the working chamber 26.

Subsequently, the controller 70 determines whether or not the calculated volume change is zero (S41). Specifically, the controller 70 determines whether or not the calculated volume change is smaller than a determination value. The determination value is determined such that when the calculated volume change is smaller than the determination value, the controller 70 can determine that the change in the volume of the working chamber 26 is substantially zero or approximately zero. For example, the determination value is set to a value slightly greater than zero.

In the case where the controller 70 determines in S41 that the calculated volume change is not zero (S41: NO), the controller 70 moves the diaphragm 23 to the neutral position described above (S42). In the case where the diaphragm 23 is located at the above-mentioned neutral position, the diaphragm 23 receives only the pressure of the operation air within the working chamber 26 and the pressure of the resist solution R in contact with the surface of the diaphragm 23 opposite the working chamber 26.

The controller 70 then changes the set pressure (S43). Specifically, the controller 70 changes the set pressure in accordance with the calculated volume change such that the volume change can quickly become close to zero. For example, in the case where the volume of the working chamber 26 has decreased, the controller 70 raises the set pressure, and in the case where the volume of the working chamber 26 has increased, the controller 70 lowers the set pressure. Further, the controller 70 changes the set pressure such that the greater the rate at which the volume of the working chamber 26 decreases, the greater the degree to which the set pressure is raised and such that the greater the rate at which the volume of the working chamber 26 increases, the greater the degree to which the set pressure is lowered. Subsequently, the controller 70 again executes the series of processes from the process of S35.

Meanwhile, in the case where the controller 70 determines in S41 that the calculated volume change is zero (S41: YES), the controller 70 estimates the suction-side hydraulic head pressure (namely, the pressure of the fluid) (S44). Specifically, the controller 70 uses, as an estimated suction-side hydraulic head pressure, the set pressure for the working chamber 26 in a state in which the change in the volume of the working chamber 26 has become zero; namely, the pressure detected by the pressure sensor 72 in the state in which the change in the volume of the working chamber 26 has become zero. After that, the controller 70 ends the series of processes (END).

Figure 6:
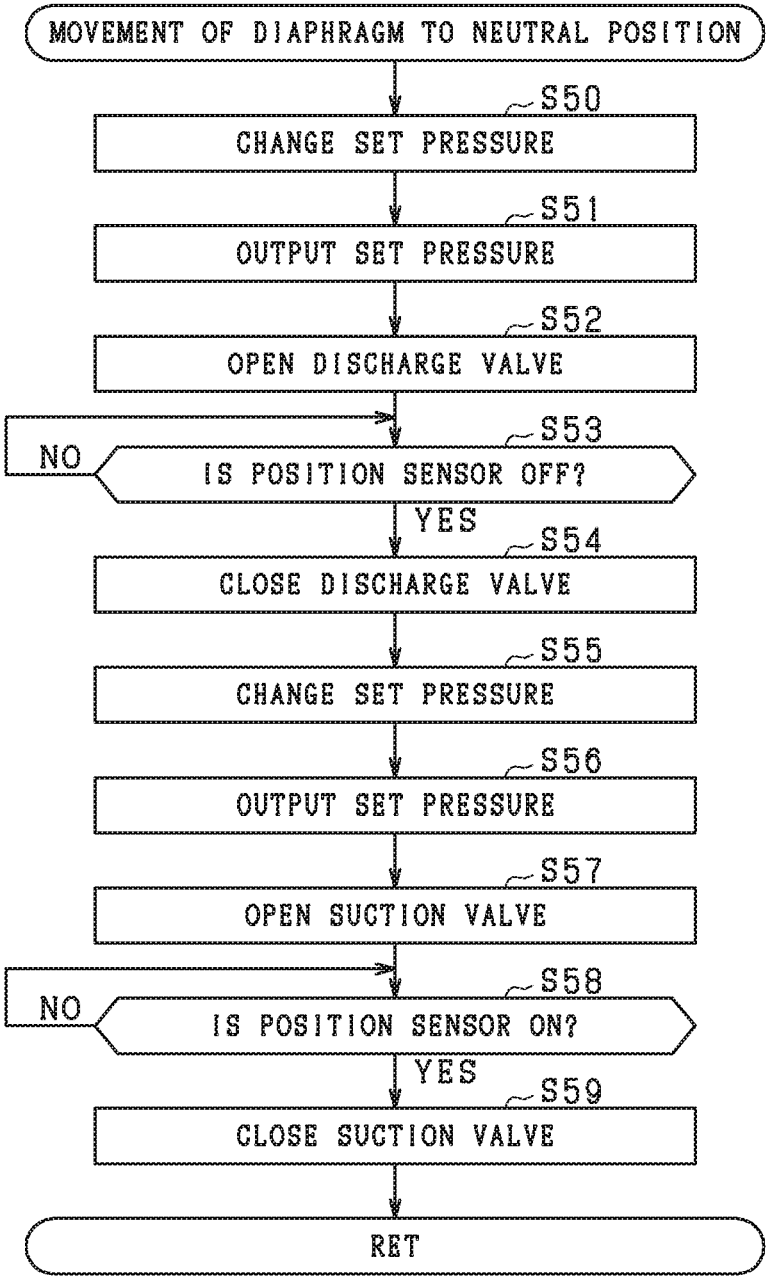
FIG. 6 is a flowchart showing a series of processes for moving the diaphragm of the pump to its neutral position.

Movement of Diaphragm to Neutral Position:

FIG. 6 is a flowchart showing the series of processes for moving the diaphragm 23 to the neutral position (S33 in FIG. 5). The series of processes is executed by the controller 70.

First, the controller 70 changes the set pressure for the working chamber 26 (S50). Specifically, the controller 70 changes the set pressure to a predetermined pressure at which the diaphragm 23 can be quickly moved toward the pump chamber 25 side with respect to the neutral position. The controller 70 then outputs the changed set pressure to the electro-pneumatic regulator 51 (S51). Thus, the electro-pneumatic regulator 51 controls the pressure of the working chamber 26 to the set pressure.

Subsequently, the controller 70 opens the discharge valve 46 (S52). Notably, the suction valve 40 has already been closed in the process of S32 in FIG. 5.

Subsequently, the controller 70 determines whether or not the position sensor 73 has entered the off state (S53). Specifically, the controller 70 determines whether or not the diaphragm 23 has moved to the pump chamber 25 side with respect to the neutral position. In the case where the controller 70 determines that the position sensor 73 has not yet entered the off state (S53: NO), the controller 70 waits by repeatedly executing the determination in S53.

Meanwhile, in the case where the controller 70 determines in S53 that the position sensor 73 has entered the off state (S53: YES), the controller 70 closes the discharge valve 46 (S54), and changes the set pressure for the working chamber 26 (S55). Specifically, the controller 70 changes the set pressure to a predetermined pressure at which the diaphragm 23 can be moved to the neutral position at a proper speed. The predetermined pressure is set to a pressure at which the diaphragm 23 can be moved to the neutral position without fail and the diaphragm 23 does not move greatly toward the working chamber 26 side with respect to the neutral position. The controller 70 then outputs the changed set pressure to the electro-pneumatic regulator 51 (S56). Thus, the electro-pneumatic regulator 51 controls the pressure of the working chamber 26 to the set pressure.

Subsequently, the controller 70 opens the suction valve 40 (S57).

Subsequently, the controller 70 determines whether or not the position sensor 73 has entered the on state (S58). Specifically, the controller 70 determines whether or not the diaphragm 23 has moved to the neutral position. In the case where the controller 70 determines that the position sensor 73 has not yet entered the on state (S58: NO), the controller 70 waits by repeatedly executing the determination in S58.

Meanwhile, in the case where the controller 70 determines in S58 that the position sensor 73 has entered the on state (S58: YES), the controller 70 closes the suction valve 40 (S59). Thus, the diaphragm 23 stops at the neutral position. The controller 70 then returns to the process of S33 and subsequent processes in FIG. 5 (RET).

The present embodiment having been described in detail has the following advantages.

By the controller 70, a state in which the volume of the working chamber 26 cannot be changed is created, and the pressure of the working chamber 26 is changed by controlling the pump drive section 59. As a result, the operation air flows into or flows out of the working chamber 26. In a state in which the volume of the working chamber 26 cannot be changed, the operation air flowing into or flowing out of the working chamber 26 contributes to change in the pressure of the working chamber 26. The amount of change in the pressure of the working chamber 26 caused by the operation air flowing into or flowing out of the working chamber 26 changes with the volume of the working chamber 26 at the time of creation of a state in which the volume of the working chamber 26 cannot be changed (namely, changes with the initial volume V(0) of the working chamber 26). Therefore, the relation between the pressure change amount of the working chamber 26 and the integrated flow rate of the operation air (i.e., the amount of the operation air flowing into or flowing out of the working chamber 26) reflects the initial volume V(0) of the working chamber 26. Accordingly, the initial volume V(0) of the working chamber 26 can be calculated from the pressure change amount of the working chamber 26 and the integrated flow rate of the operation air flowing into the working chamber 26.

After a state in which the volume of the working chamber 26 can be changed from the initial volume V(0) has been created, the integrated flow rate is calculated from the flow rate of the operation air detected by the flow rate sensor 71. The integrated flow rate in the state in which the volume of the working chamber 26 can be changed correlates with the volume change amount $\Delta V(n+1)$ of the working chamber 26. Therefore, the post-change volume V(n+1) of the working chamber 26 after its volume has changed can be calculated from the integrated flow rate and the initial volume V(0). In addition, irrespective of the initial position of the diaphragm 23, the initial volume V(0) of the working chamber 26 can be calculated, whereby the post-change volume V(n+1) of the working chamber 26 can be calculated.

The pressure change corresponding flow rate QP(n+1) which is an operation air flow rate contributing to change in the pressure of the working chamber 26 is calculated by the controller 70 on the basis of the post-change volume V(n+1) and the pressure detected by the pressure sensor. Therefore, the pressure change corresponding flow rate QP(n+1) can be calculated accurately from the post-change volume V(n+1) of the working chamber 26 at that time. The integrated flow rate is then calculated from the flow rate QM(n+1) which corresponds to change in the volume of the working chamber 26 and is calculated by subtracting the pressure change corresponding flow rate QP(n+1) from the flow rate detected by the flow rate sensor 71. Therefore, the post-change volume V(n+1) of the working chamber 26 can be calculated accurately from the integrated flow rate contributing to change in the volume of the working chamber 26.

The displacement amount of the diaphragm 23 is calculated by the controller 70 on the basis of the preset relation between the volume change amount ΔV(n+1) of the working chamber 26 and the displacement amount of the diaphragm 23 and the volume change amount ΔV(n+1); i.e., the amount of change in volume from the initial volume V(0) to the post-change volume V(n+1). Therefore, the displacement amount of the diaphragm 23 can be calculated from the post-change volume V(n+1) of the working chamber 26.

By the controller 70, a state in which the volume of the working chamber 26 can be changed is created, and the pump drive section 59 is controlled such that the diaphragm 23 stops moving. In the case where the diaphragm 23 stops moving in the state in which the volume of the working chamber 26 can be changed, the force acting on the diaphragm 23 from the working chamber 26 side balances with the force acting on the diaphragm 23 from the side opposite the working chamber 26. In this state, the diaphragm 23 receives only the pressure of the operation air within the working chamber 26 and the pressure of the resist solution R in contact with the surface of the diaphragm 23 opposite the working chamber 26. Therefore, the pressure of the operation air and the pressure of the resist solution R balance with each other. Accordingly, the pressure detected by the pressure sensor in the state in which the diaphragm 23 stands still can be used as the pressure of the resist solution R.

The first embodiment may be modified as follows.

The relation between the volume of the working chamber 26 and the position of the diaphragm 23 is predetermined. Therefore, the relation between the volume of the working chamber 26 and the position of the diaphragm 23 can be set in advance on the basis of the results of an experiment or design values. In such a case, the controller 70 may be configured to calculate the position of the diaphragm 23 on the basis of the post-change volume V(n+1) and the preset relation between the volume of the working chamber 26 and the position of the diaphragm 23.

The fluid in contact with the diaphragm 23 (i.e., movable member) is not limited to liquid such as the resist solution R, and may be gas.

The pump 13 may be used as an apparatus for measuring the static pressure of the fluid. Specifically, by a procedure similar to the flowchart of FIG. 5, the static pressure of the fluid in a state in which the suction valve 40 is opened and the discharge valve 46 is closed can be measured. Also, by modifying the procedure to close the suction valve 40 instead of opening it and open the discharge valve 46 instead of closing it, the static pressure of the fluid in a state in which the suction valve 40 is closed and the discharge valve 46 is opened can be measured. Also, the static pressure of the fluid in a state in which both the suction valve 40 and the discharge valve 46 are opened can be measured. Notably, a static pressure measurement apparatus which operates in the same principle may be provided separately from the pump 13.

Second Embodiment

A second embodiment which is embodied as a gas-pressure-driven apparatus including a single-acting-type air-operated valve 113 instead of the pump 13 of FIG. 1 will now be described with reference to the drawings. The difference from the first embodiment will be mainly described. Members identical with those of the first embodiment are denoted by the same symbols and their description will be omitted.

Figure 7:
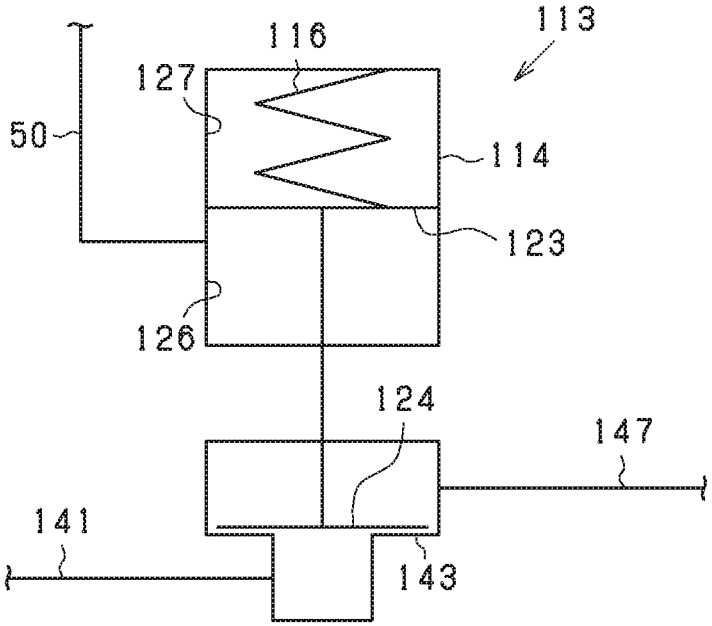
FIG. 7 is a schematic diagram showing an air-operated valve.

As shown in FIG. 7, the valve 113 includes a main body 114, a piston 123, a spring 116 (i.e., an urging member), etc. The main body 114 has a working chamber 126 into which pressurized operation air is supplied through the air pipe 50 and from which the pressurized operation air is discharged. A piston 123 (i.e., a movable member) separates the working chamber 126 from a spring chamber 127. The spring 116 urges the piston 123 from the spring chamber 127 side toward the working chamber 126 side. A valve seat 143 is provided between an inflow passage 141 and an outflow passage 147. A valve body 124 is connected to the piston 123. The valve body 124 comes into contact with and moves away from the valve seat 143. The piston 123 moves (displaces) relative to the main body 114 in accordance with the pressure of the working chamber 126. As a result, the area of a flow passage from the inflow passage 141 to the outflow passage 147 is adjusted by the valve body 124 of the valve 113. In the present embodiment, the pressurized fluid is supplied to the inflow passage 141, and the flow rate of the fluid is adjusted by the valve 113.

In a state in which the set pressure of the working chamber 126 is set to a pressure at which the valve body 124 is located at the fully closed position (a pressure lower than the lowest operation pressure of the piston 123), the initial volume V(0) of the working chamber 126 is calculated by the processing of S11 to S18 of FIG. 3. After that, in a state in which the set pressure of the working chamber 126 is set to a predetermined pressure equal to or higher than the lowest operation pressure of the piston 123, the post-change volume V(n+1) of the working chamber 126 is calculated by the processing of S19 to S24 of FIG. 3. The volume change amount ΔV(n+1) is calculated by subtracting the initial volume V(0) from the post-change volume V(n+1). Then, the volume change amount ΔV(n+1) is divided by the cross-sectional area of the working chamber 126 so as to obtain the displacement amount of the piston 123; i.e., the degree of opening of the valve 113.

Figure 8:
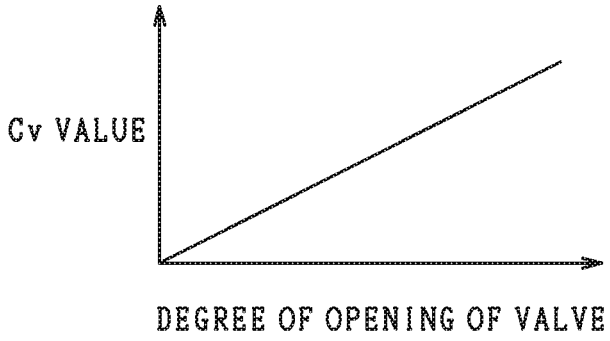
FIG. 8 is a graph showing the relation between valve opening degree and Cv value.

The degree of opening of the valve 113 correlates with a flow rate coefficient Cv. Therefore, the flow rate coefficient Cv is calculated on the basis of the degree of opening of the valve 113; specifically, is calculated on the basis of the relation of FIG. 8.

The present embodiment having been described in detail has the following advantages. Notably, here, only the advantages different from those of the first embodiment will be described.

The displacement amount of the piston 123 can be calculated by dividing the volume change amount ΔV(n+1) by the cross-sectional area of the working chamber 126. Therefore, the displacement amount of the piston 123 can be calculated simply.

Notably, the second embodiment may be modified as follows.

The initial volume V(0) may be calculated in a state in which the pressure of the working chamber 126 is equal to or higher than the lowest operation pressure of the piston 123, if the piston 123 does not move due to the pressure of the operation air.

The present invention can be embodied as a gas-pressure-driven apparatus including a double-acting-type air-operated valve which does not have the spring 116 and is configured such that the operation air is supplied to and discharged from two working chambers separated by the piston 123. In this case, in a state in which the valve body 124 has been moved to the fully closed position by supplying the operation air to the working chamber 127, the initial volume V(0) of the working chamber 126 is calculated by the processing of S11 to S18 of FIG. 3. After that, by a procedure similar to that of the second embodiment, the displacement amount of the piston 123 (the degree of opening of the valve 113) and the flow rate coefficient Cv can be calculated. Also, the initial volume V(0) of the working chamber 126 can be calculated by the processing of S11 to S18 of FIG. 3 in a state in which the valve body 124 has been moved to the fully opened position by supplying the operation air to the working chamber 126. After that, the piston 123 is moved by supplying the operation air to the working chamber 127, and the displacement amount of the piston 123 from the fully opened position can be calculated by a procedure similar to that of the second embodiment. Notably, in a state in which the piston 123 does not move due to the pressure of the operation air, the initial volume V(0) can be calculated irrespective of the pressures within the working chambers 26 and 27.

The present invention can be embodied as a gas-pressure-driven apparatus including a bellows pump in place of the pump 13 of FIG. 1. In this case as well, like the second embodiment, the displacement amount of the bellows (i.e., the movable member) can be calculated by dividing the volume change amount ΔV(n+1) by the cross-sectional area of the bellows.

Figure 9:
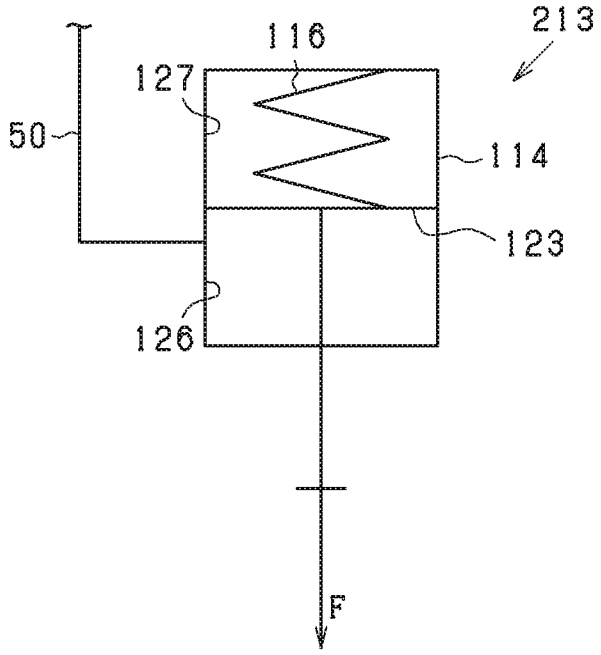
FIG. 9 is a schematic diagram showing an air cylinder.

As shown in FIG. 9, the present invention can be embodied as a gas-pressure-driven apparatus including an air cylinder 213 which works for a load F. Members identical with those of the second embodiment are denoted by the same symbols and their description will be omitted. In the case where the piston 123 (i.e., the movable member) stops in a state in which the volume of the working chamber 126 can be changed, the force acting on the piston 123 from the working chamber 126 side balances with the force acting on the piston 123 from the spring chamber 127 side (i.e., the side opposite the working chamber 126). In this state, the load F in the direction of movement of the piston 123 acts on the piston 123. The higher the pressure applied to the piston 123, the larger the force acting on the piston 123 due to the pressure. Accordingly, by controlling the supply and discharge section such that the piston 123 stops and calculating the load F such that the calculated load F increases with the pressure detected by the pressure sensor 72 in the state in which the piston 123 stands still, the load F can be calculated properly. Notably, in the case of the air cylinder 213, the state in which the volume of the working chamber 126 cannot be changed may be created by mechanically fixing the piston 123.

Notably, the above-described embodiments may be modified as follows.

The pressure sensor 72 may be one which detects the pressure of the working chamber.

In the above-described embodiments, operation air is used as the working gas supplied to and discharged from the working chamber. However, a gas other than air, such as nitrogen, may be used as the working gas.

In a state in which the volume of the working chamber is made unchangeable for calculation of the initial volume V(0) of the working chamber, the controller 70 (i.e., the control section) calculates the temperature of the working chamber such that the calculated temperature increases with the increase of the pressure detected by the pressure sensor 72. In the state in which the volume of the working chamber is made unchangeable for calculation of the initial volume V(0) of the working chamber, the ratio between the pressure and the temperature becomes constant according to the Boyle-Charles' law. Therefore, the temperature of the working chamber can be calculated properly by calculating the temperature of the working chamber such that the calculated temperature increases with the increase of the pressure detected by the pressure sensor 72.

The controller 70 (the control section) calculates the temperature of the working chamber on the basis of the preset relation among the volume, pressure, and temperature of the working chamber, the initial volume V(0) of the working chamber, and the pressure detected by the pressure sensor 72 in the state in which the volume of the working chamber is made unchangeable for calculation of the initial volume V(0) of the working chamber. The Boyle-Charles' law determines the relation among the volume, pressure, and temperature of the working chamber. Therefore, the relation among the volume, pressure, and temperature of the working chamber can be set in advance on the basis of the results of an experiment or design value. Therefore, according to the above-described configuration, the temperature of the working chamber can be calculated through use of the control for calculation of the initial volume V(0) of the working chamber.

When the post-change volume V(n+1) of the working chamber is calculated on the basis of the initial volume V(0) and the integrated flow rate, the pressure change corresponding flow rate QP(n+1) can be considered to be 0. In this case as well, since the integrated flow rate correlates with the volume change amount of the working chamber, the post-change volume V(n+1) of the working chamber can be calculated although the accuracy lowers.

The invention claimed is:

1. A method for controlling a gas-pressure-driven apparatus including a main body having a working chamber, a supply and discharge section, a movable member configured to move relative to the main body in accordance with a pressure of the working chamber, a pressure sensor, and a flow rate sensor, the method comprising:

creating a state in which a volume of the working chamber cannot be changed, and changing a pressure of the working chamber in this state by controlling, via the supply and discharge section, supply of a working gas to the working chamber and discharge of the working gas from the working chamber;

detecting a pressure of a space including the working chamber by the pressure sensor;

detecting a flow rate of the working gas flowing into and flowing out of the working chamber by the flow rate sensor;

calculating a pressure change amount on the basis of the pressure detected by the pressure sensor and calculating an integrated flow rate on the basis of the flow rate detected by the flow rate sensor when the pressure of the working chamber is changed;

calculating an initial volume of the working chamber on the basis of the pressure change amount and the integrated flow rate; and calculating a post-change volume of the working chamber after its volume has changed on the basis of the initial volume and the integrated flow rate calculated from the flow rate detected by the flow rate sensor after creation of a state in which the volume of the working chamber can be changed from the initial volume, wherein the method further comprising:

calculating a pressure change corresponding to a flow rate of the working gas which contributes to a change in the pressure of the working chamber on the basis of the post-change volume and the pressure detected by the pressure sensor; and calculating the integrated flow rate on the basis of a change in the volume of the working chamber which is calculated by subtracting the pressure change corresponding flow rate from the flow rate detected by the flow rate sensor.

2. A method for controlling a gas-pressure-driven apparatus according to claim 1, further comprising:

setting a relation between a volume change amount of the working chamber and a displacement amount of the movable member in advance; and calculating the displacement amount of the movable member on the basis of the set relation and an amount of change in volume from the initial volume to the post-change volume.

3. A method for controlling a gas-pressure-driven apparatus according to claim 1, further comprising:

setting a relation between the volume of the working chamber and a position of the movable member in advance; and calculating the position of the movable member on the basis of the set relation and the post-change volume.

4. A method for controlling a gas-pressure-driven apparatus according to claim 1, further comprising:

creating a state in which the movable member receives only the pressure of the working gas within the working chamber and the pressure of a fluid in contact with a surface of the movable member opposite the working chamber;

creating a state in which the volume of the working chamber can be changed and controlling the supply and discharge section such that the movable member stops moving; and using, as the pressure of the fluid, the pressure detected by the pressure sensor in the state in which the movable member stands still.

5. A method for controlling a gas-pressure-driven apparatus according to claim 1, further comprising:

applying a load on the movable member in a direction in which the movable member moves;

creating a state in which the volume of the working chamber can be changed and controlling the supply and discharge section such that the movable member stops moving; and calculating the load such that the calculated load increases with the increase of the pressure detected by the pressure sensor in the state in which the movable member stands still.

6. A method for controlling a gas-pressure-driven apparatus according to claim 1, further comprising:

calculating a temperature of the working chamber such that the calculated temperature increases with the increase of the pressure detected by the pressure sensor in a state in which the volume of the working chamber is made unchangeable for calculation of the initial volume of the working chamber.

7. A method for controlling a gas-pressure-driven apparatus according to claim 6, further comprising:

setting a relation between pressure and temperature of the working chamber in advance; and calculating the temperature of the working chamber on the basis of the set relation, the initial volume of the working chamber, and the pressure detected by the pressure sensor in a state in which the volume of the working chamber is made unchangeable for calculation of the initial volume of the working chamber.

8. A gas-pressure-driven apparatus comprising:

a main body having a working chamber to which a working gas is supplied and from which the working gas is discharged;

a supply and discharge section configured to supply the working gas to the working chamber and to discharge the working gas from the working chamber;

a movable member configured to move relative to the main body in accordance with a pressure of the working chamber;

a pressure sensor configured to detect a pressure of a space including the working chamber;

a flow rate sensor configured to detect a flow rate of the working gas flowing into and flowing out of the working chamber; and a control section which is configured to create a state in which a volume of the working chamber cannot be changed, to change the pressure of the working chamber in this state by controlling the supply and discharge section, and to calculate a pressure change amount on the basis of the pressure detected by the pressure sensor and to calculate an integrated flow rate on the basis of the flow rate detected by the flow rate sensor when the pressure of the working chamber is changed, the control section being configured to calculate an initial volume of the working chamber on the basis of the pressure change amount and the integrated flow rate, and to calculate a post-change volume of the working chamber after its volume has changed on the basis of the initial volume and the integrated flow rate calculated from the flow rate detected by the flow rate sensor after creation of a state in which the volume of the working chamber can be changed from the initial volume, wherein the control section is further configured to calculate a pressure change corresponding to a flow rate of the working gas which contributes to a change in the pressure of the working chamber on the basis of the post-change volume and the pressure detected by the pressure sensor, and to calculate the integrated flow rate on the basis of a change in the volume of the working chamber which is calculated by subtracting the pressure change corresponding flow rate from the flow rate detected by the flow rate sensor.

9. A gas-pressure-driven apparatus according to claim 8, wherein the control section is further configured to calculate a displacement amount of the movable member on the basis of a preset relation between a volume change amount of the working chamber and the displacement amount of the movable member, and an amount of change in volume from the initial volume to the post-change volume.

10. A gas-pressure-driven apparatus according to claim 8, wherein the control section is further configured to calculate a position of the movable member on the basis of a preset relation between the volume of the working chamber and the position of the movable member, and the post-change volume.

11. A gas-pressure-driven apparatus according to claim 8, wherein the movable member receives only the pressure of the working gas within the working chamber and the pressure of a fluid in contact with a surface of the movable member opposite the working chamber; and the control section is further configured to create a state in which the volume of the working chamber can be changed, to control the supply and discharge section such that the movable member stops moving, and to use, as the pressure of the fluid, the pressure detected by the pressure sensor in the state in which the movable member stands still.

12. A gas-pressure-driven apparatus according to claim 8, further comprising:

a load that acts on the movable member in a direction in which the movable member moves, wherein the control section is further configured to create a state in which the volume of the working chamber can be changed, to control the supply and discharge section such that the movable member stops moving, and to calculate the load such that the calculated load increases with the increase of the pressure detected by the pressure sensor in the state in which the movable member stands still.

13. A gas-pressure-driven apparatus according to claim 8, wherein the control section is further configured to calculate a temperature of the working chamber such that the calculated temperature increases with the increase of the pressure detected by the pressure sensor in a state in which the volume of the working chamber is made unchangeable for calculation of the initial volume of the working chamber.

14. A gas-pressure-driven apparatus according to claim 13, wherein the control section is further configured to calculate the temperature of the working chamber on the basis of a preset relation between pressure and temperature of the working chamber, the initial volume of the working chamber, and the pressure detected by the pressure sensor in a state in which the volume of the working chamber is made unchangeable for calculation of the initial volume of the working chamber.

* * * * *